US011585141B2

(12) United States Patent
Yun

(10) Patent No.: US 11,585,141 B2
(45) Date of Patent: Feb. 21, 2023

(54) APPARATUS FOR PREVENTING SLIDING DOOR FOR VEHICLE FROM SWAYING

(71) Applicants: Hyundai Motor Company, Seoul (KR); Kia Corporation, Seoul (KR)

(72) Inventor: Hyung-In Yun, Seoul (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 19 days.

(21) Appl. No.: 17/226,353

(22) Filed: Apr. 9, 2021

(65) Prior Publication Data

US 2022/0106825 A1 Apr. 7, 2022

(30) Foreign Application Priority Data

Oct. 7, 2020 (KR) ..... 10-2020-0129546

(51) Int. Cl.
*E05F 11/04* (2006.01)
*E05D 15/10* (2006.01)

(52) U.S. Cl.
CPC ..... *E05F 11/04* (2013.01); *E05D 15/101* (2013.01); *E05D 2015/1026* (2013.01)

(58) Field of Classification Search
CPC ..... E05F 11/04; E05D 2015/1026
See application file for complete search history.

(56) References Cited

U.S. PATENT DOCUMENTS 5,046,283 A * 9/1991 Compeau ..... B60J 5/062 49/138
7,611,190 B1 * 11/2009 Elliott ..... B60J 5/06 49/248
9,777,811 B2 * 10/2017 Choi ..... B60J 5/06
10,384,519 B1 * 8/2019 Brown ..... B60J 5/047
10,480,232 B2 * 11/2019 Ishikawa ..... E05D 15/1081
2003/0005635 A1 * 1/2003 Haag ..... E05D 15/1047 49/141
2010/0095595 A1 * 4/2010 Hanaki ..... E05D 15/101 49/359
2013/0205668 A1 * 8/2013 Neag ..... B60J 10/86 16/94 R
2014/0173989 A1 * 6/2014 Choi ..... E05F 15/649 49/350
2015/0183303 A1 * 7/2015 Choi ..... E05D 15/0621 49/404
2015/0291015 A1 * 10/2015 Choi ..... B60J 5/12 49/150

(Continued)

FOREIGN PATENT DOCUMENTS

KR 101684536 B1 12/2016

*Primary Examiner* — Marcus Menezes
(74) *Attorney, Agent, or Firm* — Slater Matsil, LLP

(57) ABSTRACT

An apparatus for a vehicle includes a door rail configured to be installed on a door panel of a door, a vehicle body rail configured to be coupled to a vehicle body so as to be opposite to the door rail, a vehicle body rail slider coupled to one surface of the vehicle body rail so as to be slidable in a front-rear direction along the vehicle body rail, a door rail slider coupled to the door rail so as to be slidable in the front-rear direction along the door rail, a pulley rotatable in conjunction with a movement of the vehicle body rail slider, a speed reducer directly connected to the pulley, and a second arm hingedly coupled to the speed reducer and configured to move the door rail slider.

20 Claims, 7 Drawing Sheets

(56) References Cited

U.S. PATENT DOCUMENTS

| | | | | |
|---|---|---|---|---|
| 2016/0356069 | A1* | 12/2016 | Choi | F16H 19/06 |
| 2018/0087304 | A1* | 3/2018 | Bauer | E05D 15/1047 |
| 2018/0126829 | A1* | 5/2018 | Ishikawa | E05D 15/101 |
| 2018/0298671 | A1* | 10/2018 | Roppongi | E05F 15/659 |
| 2020/0131822 | A1* | 4/2020 | Urano | B60J 5/047 |
| 2020/0181968 | A1* | 6/2020 | Suzuki | E05F 15/646 |
| 2020/0399944 | A1* | 12/2020 | Morioka | E05F 15/646 |
| 2021/0277695 | A1* | 9/2021 | Bakker | E05F 15/646 |

* cited by examiner

[PRIOR ART]

APPARATUS FOR PREVENTING SLIDING DOOR FOR VEHICLE FROM SWAYING

CROSS-REFERENCE TO RELATED APPLICATIONS

This application claims the benefit of Korean Patent Application No. 10-2020-0129546, filed in the Korean Intellectual Property Office on Oct. 7, 2020, which application is hereby incorporated herein by reference.

TECHNICAL FIELD

Embodiments relate to an apparatus for preventing sliding door for vehicle from swaying.

BACKGROUND

In general, a vehicle has an occupant compartment having a predetermined size in which a driver or an accompanied occupant may be seated. Occupant compartment opening/closing doors are installed on a vehicle body to open or close the occupant compartment.

Sliding type occupant compartment opening/closing doors include a front sliding door installed at a front side in a longitudinal direction of a vehicle and a rear sliding door installed at a rear side in the longitudinal direction of the vehicle. The front sliding door and the rear sliding door are typically installed to be moved along rails mounted on a vehicle body or the doors.

FIG. 1 is a view illustrating a vehicle body of a vehicle having a door opened or closed in a sliding manner in the related art. The door in the related art, which operates in a sliding manner to open or close an occupant compartment, includes an upper rail 10 configured to support an upper portion of a door 1, when the door 1 slides, in order to ensure a forward/rearward sliding operation of the door 1 coupled to a vehicle body 2, a center rail 20 configured to support a central portion of the door 1 when the door 1 slides, and a lower rail 30 configured to support a lower portion of the door 1 when the door 1 slides.

However, because the rails 10, 20, and 30 for sliding the door 1 and components related to the rails 10, 20, and 30 are installed on the vehicle body, there is concern that a weight of the vehicle and the number of components of the vehicle are increased and a degree of design freedom of the vehicle deteriorates.

Therefore, a 2-rail type door apparatus for a vehicle, in which only center and lower rails support the door so that the door is slidable, has been developed to solve the above-mentioned problems in the related art. As an example of the technology, Korean Patent No. 10-1584536 discloses a sliding door apparatus for a vehicle.

The publicly-known technology shows a configuration in which a door rail (center rail) is mounted on a sliding door and a vehicle body rail is mounted on a vehicle body, such that a center slider coupled to the door rail and a lower slider coupled to the vehicle body rail are moved to open or close the sliding door.

Referring to FIG. 1, the sliding structure in the related art has two support points at which the sliding door is supported, and the two support points include a contact point A between the vehicle body rail and the lower slider and a contact point B between the center rail and the center slider. However, as illustrated in FIG. 2, there is a problem in that the door 1 sways in a direction indicated by the arrow illustrated in FIG. 2 with respect to an imaginary axis X that connects the two contact points. There is concern that the sway of the door 1 may cause gaps between the door and a door frame when the door is opened or closed, and the sway of the door 1 may degrade marketability of the vehicle.

SUMMARY

Embodiments of the present invention relate to an apparatus for preventing a sliding door for a vehicle from swaying.

In an example embodiment the apparatus includes a center rail installed at a central portion of a door panel of a door coupled to a vehicle body. A door rail is installed at a lower side of the door panel. A vehicle body rail is coupled to the vehicle body so as to be opposite to the door rail. A vehicle body rail slider is coupled to one surface of the vehicle body rail so as to be slidable in a front-rear direction along the vehicle body rail. A door rail slider coupled to the door rail so as to be slidable in the front-rear direction along the door rail. A pulley can be rotated in conjunction with a movement of the vehicle body rail slider. A speed reducer is directly connected to the pulley and configured to reduce a rotational speed of the pulley. A second arm is hingedly coupled to the speed reducer and configured to move the door rail slider.

Embodiments can provide an apparatus for preventing a sliding door for a vehicle from swaying where the apparatus has a door opened or closed in a sliding manner and a pulley structure for preventing the sliding door from swaying during an operation of opening or closing the door.

In comparison with a 2-rail sliding door in the related art only having a center rail and a lower rail, the apparatus according to embodiments of the present invention configured as described above may support the door at three support points. Therefore, it is possible to stably open or close the sliding door without swaying and to prevent the occurrence of gaps between the door and a door frame caused by the sway of the door.

Since the apparatus for preventing a sliding door for a vehicle from swaying has a comparatively simple structure, the apparatus for preventing a sliding door for a vehicle from swaying according to embodiments of the present invention may be easily applied without additionally changing a structure of a sliding door in the related art.

Since the pulley and the speed reducer are adopted, it is possible to tune a rotation amount of the second arm, which is rotated in accordance with a movement distance of the vehicle body rail slider when the door is opened. Therefore, it is possible to change an operating trajectory of the door to a desired trajectory when opening or closing the door, thereby obtaining an effect of improving a degree of design freedom.

DETAILED DESCRIPTION OF ILLUSTRATIVE EMBODIMENTS

Hereinafter, a configuration and an operation of an apparatus for preventing a sliding door for a vehicle from swaying according to embodiments of the present invention will be described in detail with reference to the drawings.

However, the disclosed drawings are provided as an example for fully conveying the spirit of the present invention to those skilled in the art. Therefore, the present invention is not limited to the drawings disclosed below and may be specified as other aspects.

Unless otherwise defined, the terminologies used in the specification of the present invention have the meanings that a person with ordinary skill in the art to which the present invention pertains typically understands, and in the following description and the accompanying drawings, a detailed description of publicly known functions and configurations will be omitted so as to avoid unnecessarily obscuring the subject matter of the present invention.

Figure 1:
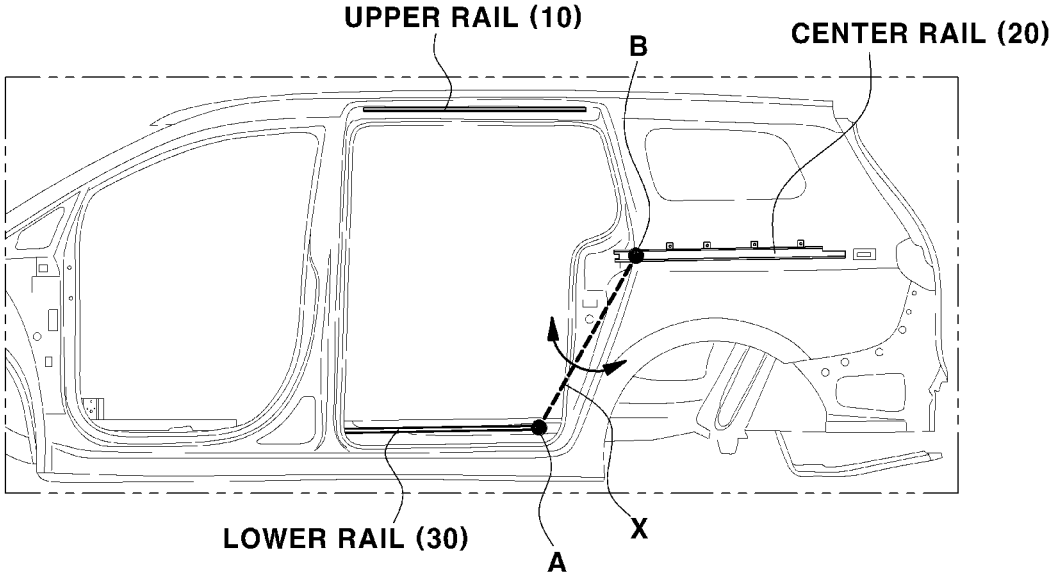
FIG. 1 is a configuration view illustrating a door opened or closed in a sliding manner in the related art.
Figure 2:
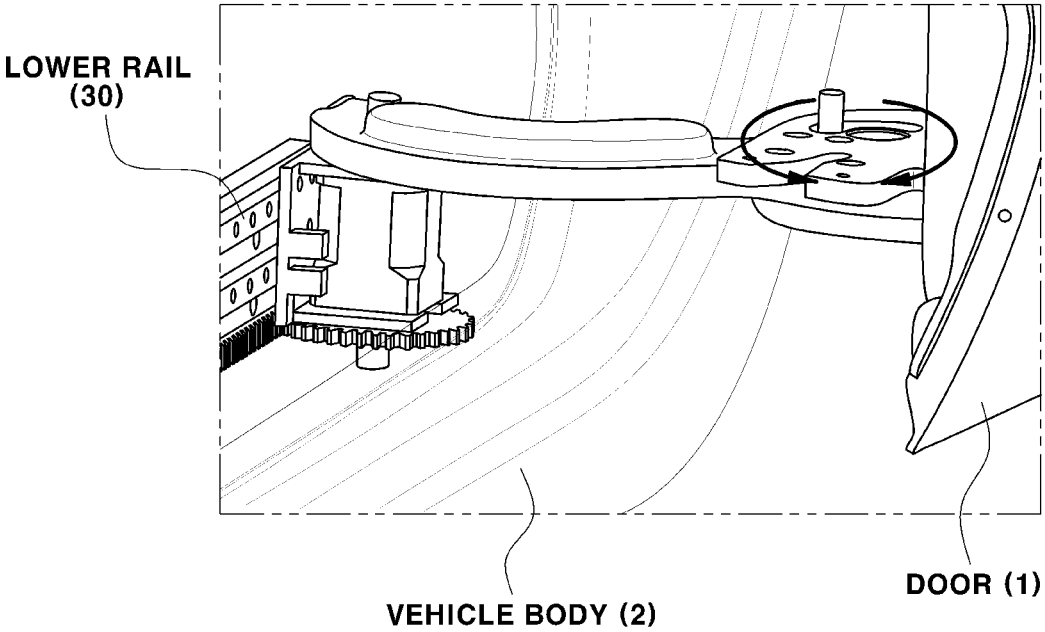
[PRIOR ART] FIG. 2
FIG. 2 is a detailed view illustrating the door opened or closed in a sliding manner in the related art.
Figure 3:
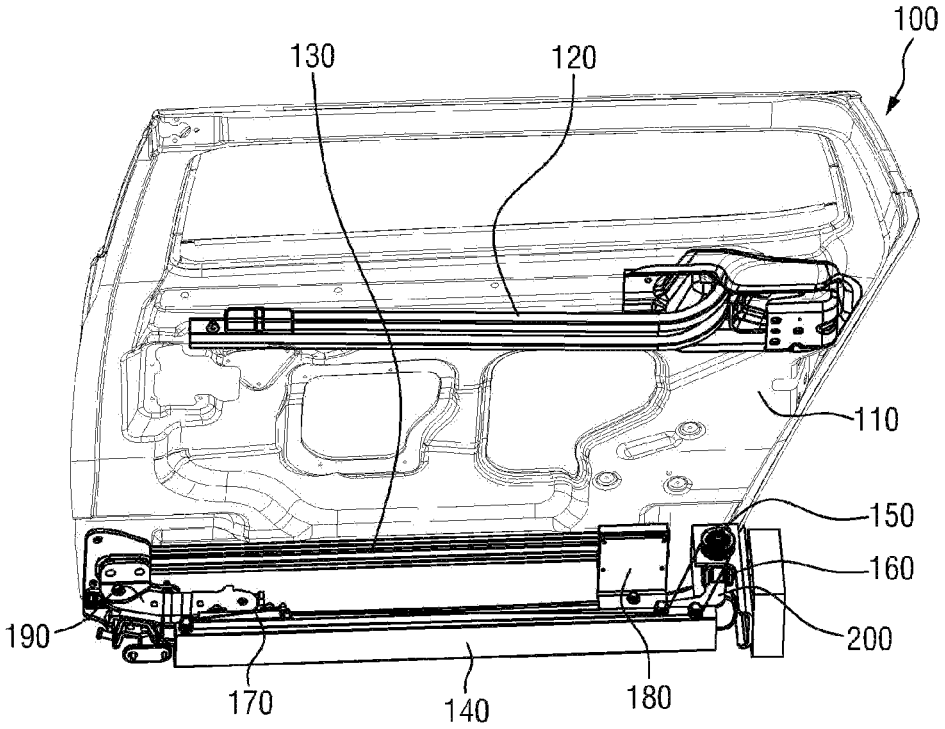
FIG. 3 is a perspective view illustrating an apparatus for preventing a sliding door for a vehicle from swaying according to the present invention.
Figure 4:
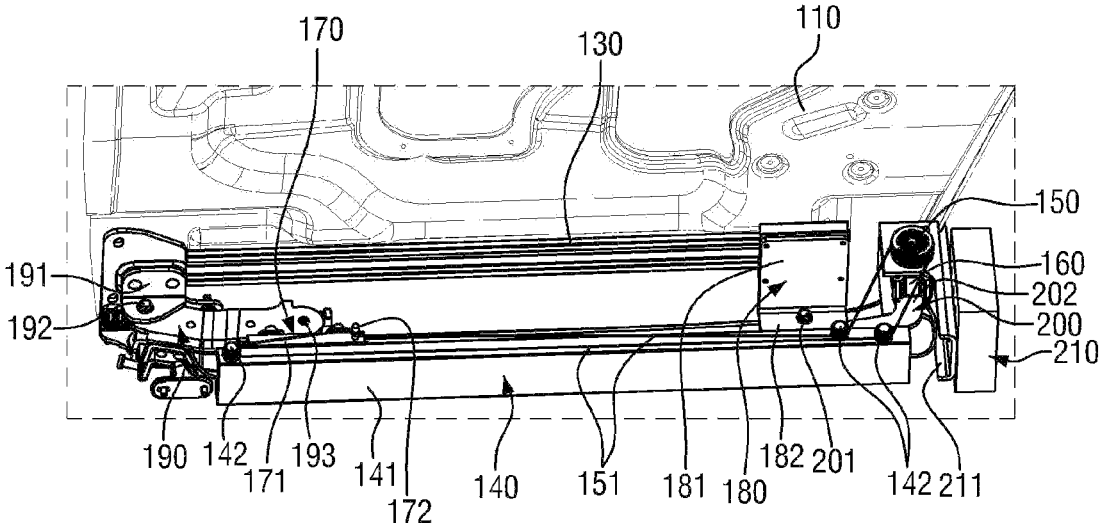
FIG. 4 is a perspective view illustrating a detailed configuration of the apparatus for preventing a sliding door for a vehicle from swaying according to the present invention.
Figure 5:
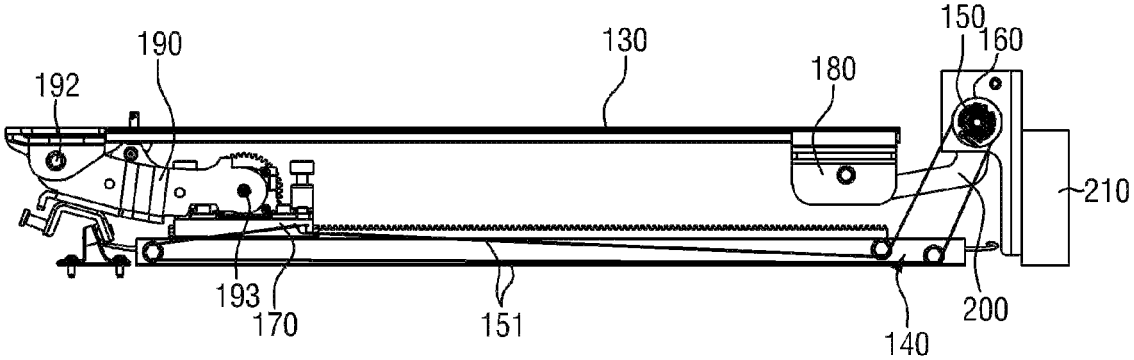
FIG. 5 is a top plan view illustrating a detailed configuration of the apparatus for preventing a sliding door for a vehicle from swaying according to the present invention.

FIG. 3 is a perspective view illustrating an apparatus for preventing a sliding door for a vehicle from swaying according to the present invention, FIG. 4 is a perspective view illustrating a detailed configuration of the apparatus for preventing a sliding door for a vehicle from swaying according to the present invention, and FIG. 5 is a top plan view illustrating a detailed configuration of the apparatus for preventing a sliding door for a vehicle from swaying according to the present invention.

Referring to the drawings, an apparatus for preventing a sliding door for a vehicle from swaying (hereinafter, referred to as a 'sway prevention apparatus') according to the present invention includes a center rail 120 installed at a central portion of a door panel 110 of a door 100 coupled to a vehicle body 2 of a vehicle, a door rail 130 installed at a lower side of the door panel 110, and a vehicle body rail 140 coupled to the vehicle body 2 so as to be opposite to the door rail 130.

The center rail 120, the door rail 130, and the vehicle body rail 140 each have a bar or rod shape and extend in parallel with the door panel 110. In the present exemplary embodiment, the center rail 120 and the door rail 130 each have a rail shape including a pair of rods, and the vehicle body rail 140 has a frame 141 formed in the form of a quadrangular pipe.

The sway prevention apparatus according to the present invention includes a vehicle body rail slider 170 coupled to one surface of the vehicle body rail 140 at one side in a direction of the door panel 110 so as to be slidable in a front-rear direction along the vehicle body rail 140, and a door rail slider 180 coupled to the door rail 130 so as to be slidable in the front-rear direction along the door rail 130.

In order to slide the vehicle body rail slider 170 in conjunction with the operation of the door 100, a first arm 190 is connected to the vehicle body rail slider 170.

Specifically, a bracket hinge 192 provided at one side of the first arm 190 is hingedly coupled to a bracket 191 attached to the door panel 110, and a slider hinge 193 provided at the other side of the first arm 190 is hingedly coupled to a body 171 of the vehicle body rail slider 170.

In order to slide the door rail slider 180 in conjunction with the operation of the door 100, a second arm 200 is connected to the door rail slider 180.

Specifically, the door rail slider 180 has a vertical surface 181 coupled to the door rail 130, and a horizontal surface 182 bent to be perpendicular to the vertical surface 181. One hinge 201 of the second arm 200 is hingedly coupled to the door rail slider 180, and the other hinge 202 of the second arm 200 is hingedly coupled to a shaft (not illustrated) of a speed reducer 160 installed on a fixing plate 211 of a fixing unit 210 attached to the vehicle body 2. A pulley 150 around which a wire 151 is wound is installed at an upper side of the speed reducer 160.

The speed reducer 160 is directly connected to the pulley 150 attached to the upper side of the speed reducer 160 and serves to reduce a rotational speed (rpm) of the pulley 150. Therefore, a rotation amount of the second arm 200 hingedly coupled to the shaft of the speed reducer 160 is adjusted in accordance with a reduction ratio of the speed reducer 160.

The wire 151 wound around the pulley 150 is extended along conveying rollers 142 provided on the frame 141 of the vehicle body rail 140 and returns to the pulley 150 via a connecting roller 172 provided on the body 171 of the vehicle body rail slider 170.

Therefore, when the vehicle body rail slider 170 moves in the front-rear direction in conjunction with the operation of the door 100, the wire 151 extended via the connecting roller 172 of the vehicle body rail slider 170 is moved by receiving force clockwise or counterclockwise, and the pulley 150 is rotated by the movement of the wire 151. The rotational force of the pulley 150 is transmitted to the other hinge 202 of the second arm 200 in a state in which the rotational speed of the pulley 150 is reduced by the speed reducer 160, such that the second arm 200 is rotated.

Meanwhile, a center rail slider 122 is installed to be movable in the front-rear direction along the center rail 120 of the door panel 110, and the center rail slider 122 is connected to a center rail roller 121 attached to the vehicle body 2.

Therefore, the center rail slider 122 connected to the center rail roller 121 is moved in the front-rear direction along the center rail 120 by an operation of opening or closing the door 100.

In the sway prevention apparatus according to the present invention configured as described above, the vehicle body rail slider 170 and the door rail slider 180 slide in the front-rear direction on the vehicle body rail 140 and the door rail 130, respectively, by the operation of opening or closing the door 100. Further, in conjunction with the above-mentioned operations, the first arm 190 and the second arm 200 are unfolded and deployed in a direction toward the outside of the vehicle body 2 or folded in a direction toward the inside of the vehicle body 2. The specific operations will be described below.

Next, an operation of the apparatus for preventing a sliding door for a vehicle from swaying according to the present invention configured as described above will be described.

FIGS. 6A to 6E are views illustrating states in which the sliding door for a vehicle according to the present invention operates.

The drawings illustrate the operating states in which the door 100 installed on the vehicle body 2 is opened. For convenience of description, a side at which the first arm 190 is installed is defined as a front side, and a side at which the second arm 200 is installed is defined as a rear side.

Figure 6A:
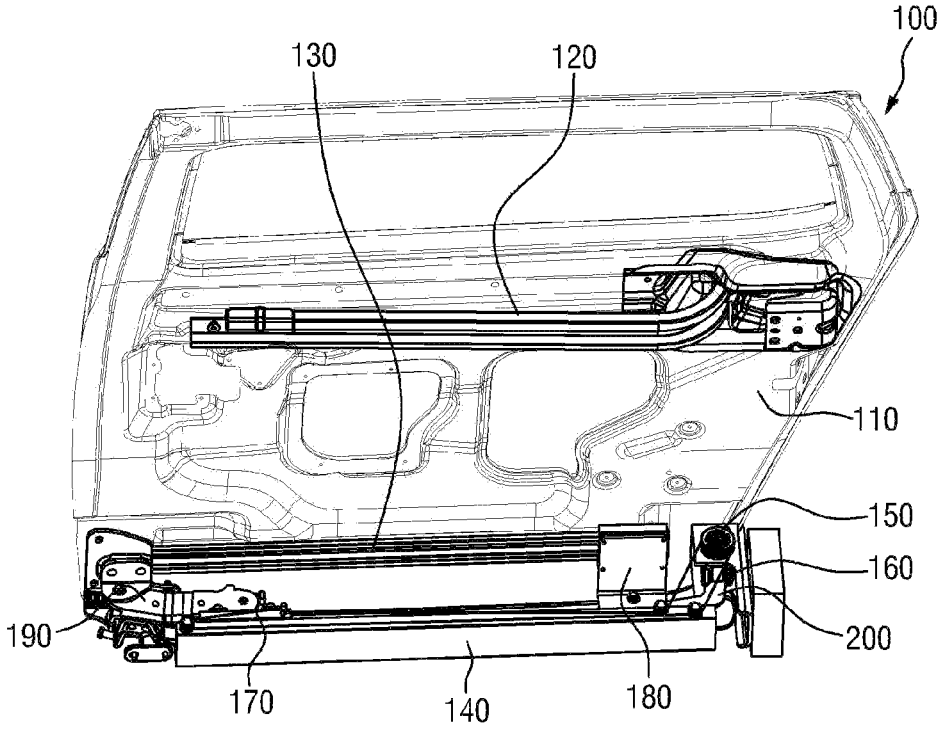
FIGS. 6A to 6E are views illustrating states in which the sliding door for a vehicle according to the present invention operates.

First, in a state in which the door 100 is closed as illustrated in FIG. 6A, the door 100 is positioned in parallel with the vehicle body rail 140, the vehicle body rail slider 170 is positioned at a front end on the vehicle body rail 140, and the door rail slider 180 is positioned at a rear end on the door rail 130.

Figure 6B:
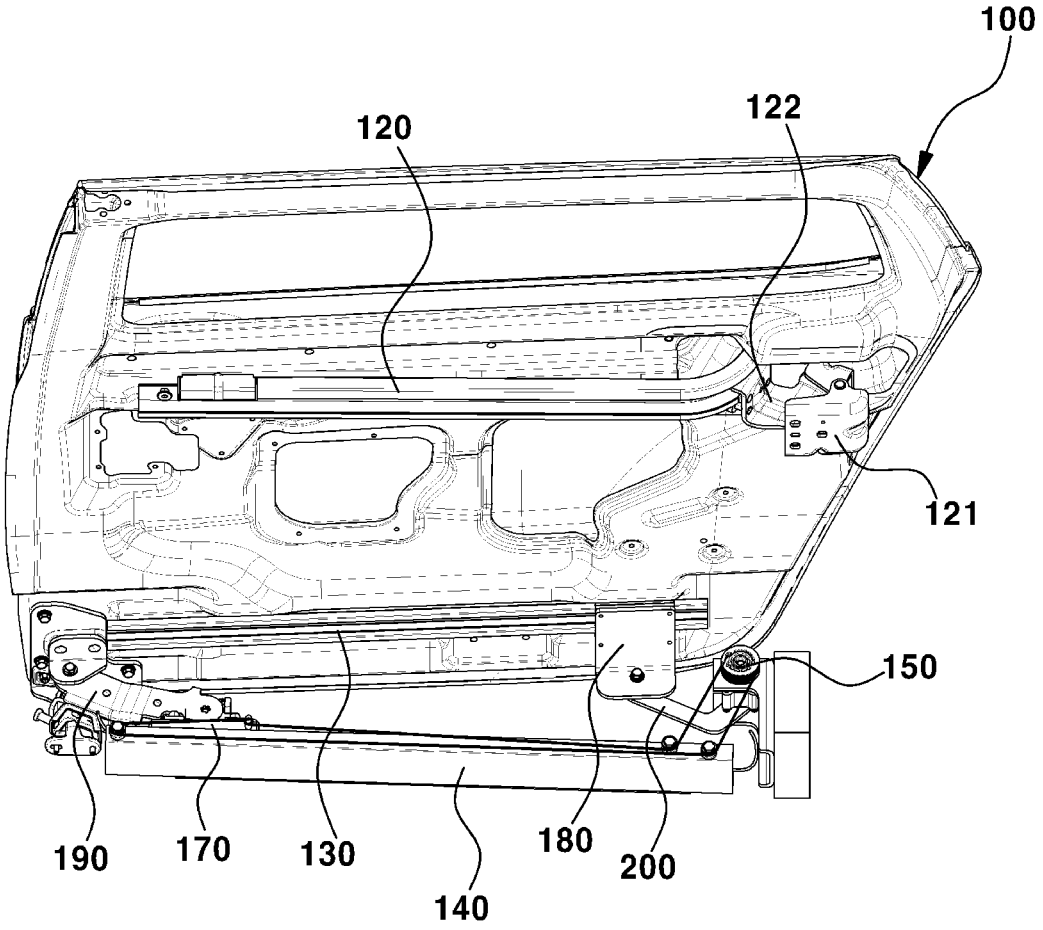

In this state, when the door 100 is moved rearward while being opened, the first arm 190 coupled to the door panel 110 is moved rearward along with the movement of the door 100, and thus begins to move the vehicle body rail slider 170 rearward, as illustrated in FIG. 6B.

Figure 6C:
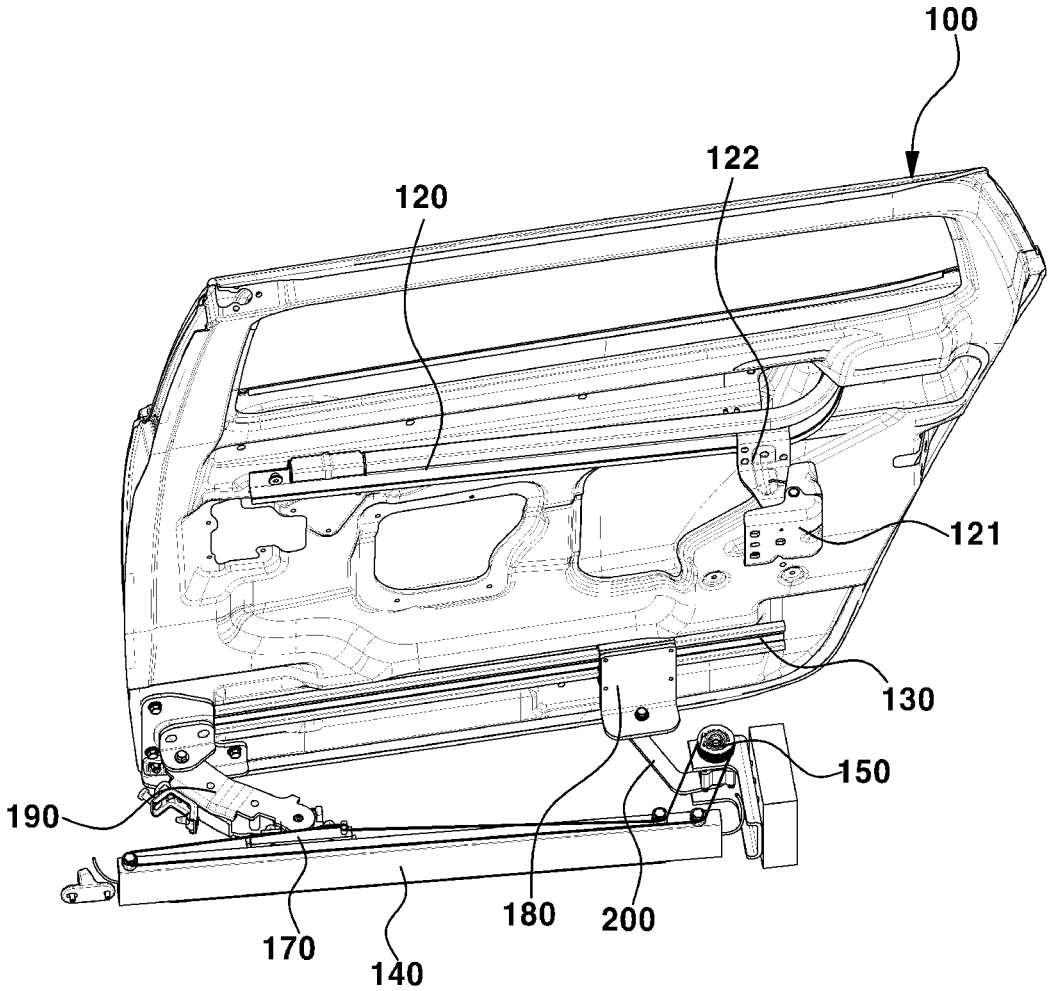

In this state, when the door 100 is still moved rearward, as illustrated in FIG. 6C, the wire 151 extended via the connecting roller 172 of the vehicle body rail slider 170 being moved rearward is moved by receiving force clockwise, the pulley 150 is rotated by the movement of the wire 151, and the rotational force of the pulley 150 is transmitted to the other hinge 202 of the second arm 200 in a state in which the rotational speed of the pulley 150 is reduced by the speed reducer 160, such that the second arm 200 is deployed toward the outside of the vehicle body 2, and the door rail slider 180 is moved forward along the door rail 130.

The center rail slider 122 connected to the center rail roller 121 attached to the vehicle body 2 is moved forward along the center rail 120 by the operation of opening the door 100.

Figure 6D:
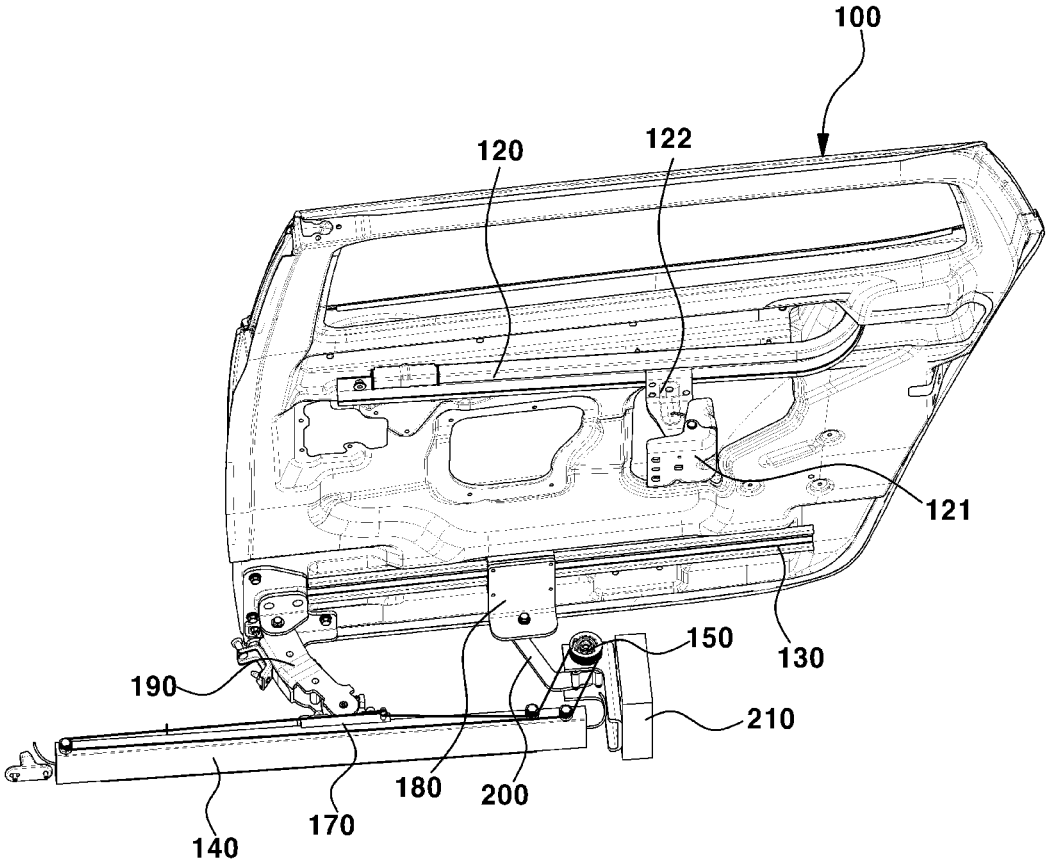
Figure 6E:
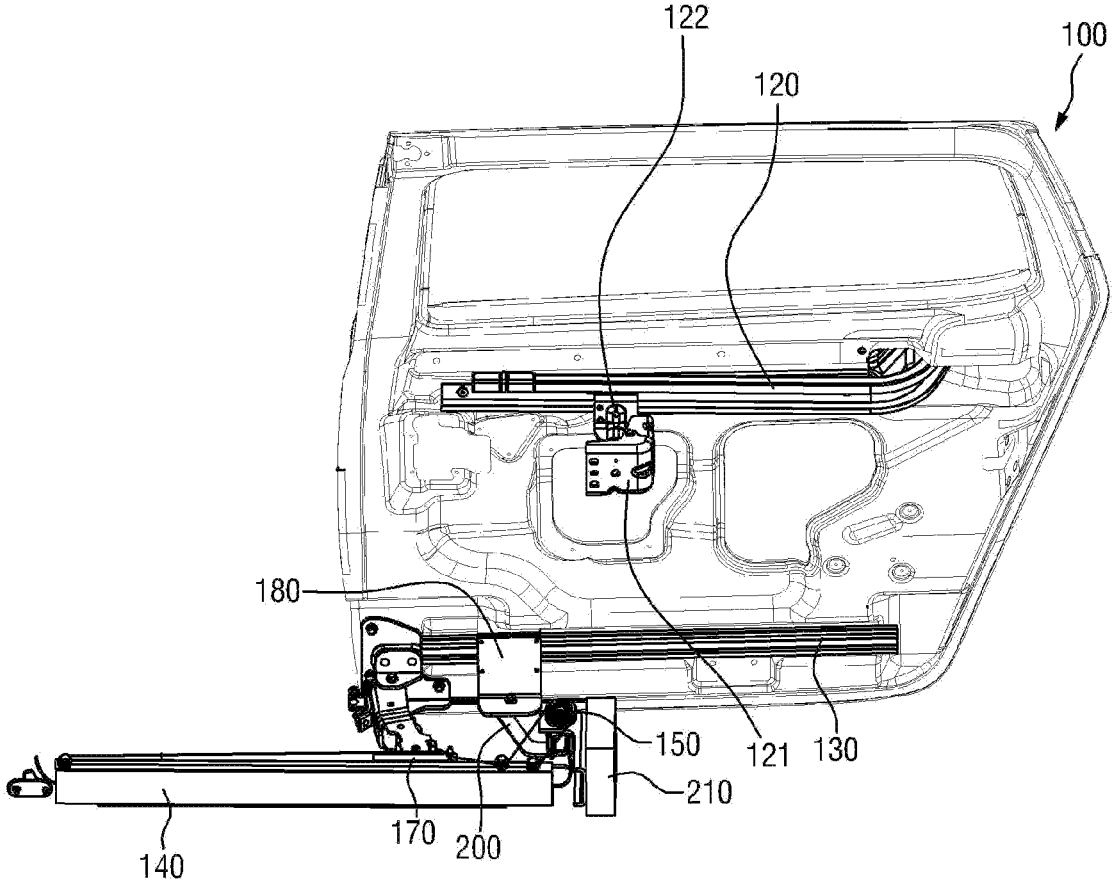

Next, as the door 100 continues to be moved rearward, as illustrated in FIG. 6D, the vehicle body rail slider 170 is moved rearward, and the door rail slider 180 is moved forward. As illustrated in FIG. 6E, when the door 100 of the vehicle is fully opened, the vehicle body rail slider 170 and the door rail slider 180 are positioned at points closest to each other in a state in which the first arm 190 and the second arm 200 are fully deployed toward the outside of the vehicle 2.

Meanwhile, an operation of closing the door 100 according to the present invention is performed in the reverse order to the operation of opening the door 100.

Accordingly, the sway prevention apparatus according to the present invention, which operates as described above, may support the movement of the door 100 at three points by the vehicle body rail slider 170, the door rail slider 180, and the center rail slider 122 when the door 100 is opened or closed. Therefore, it is possible to prevent the sway of the door 100, to stably open or close the door 100, and to prevent the occurrence of gaps between the door and a door frame caused by the sway of the door, in comparison with a configuration in the related art in which a movement of a door is supported only at two points by a center slider and a lower slider.

What is claimed is:

1. An apparatus for use with a vehicle, the apparatus comprising:

a door rail configured to be installed on a door panel of a door;

a vehicle body rail configured to be coupled to a vehicle body so as to be opposite to the door rail;

a vehicle body rail slider coupled to one surface of the vehicle body rail so as to be slidable in a front-rear direction along the vehicle body rail;

a door rail slider coupled to the door rail so as to be slidable in the front-rear direction along the door rail;

a pulley rotatable in conjunction with a movement of the vehicle body rail slider, wherein the vehicle body rail slider and the door rail slider can slide in the front-rear direction on the vehicle body rail and the door rail, respectively by an operation of opening or closing the door to rotate the pulley;

a speed reducer directly connected to the pulley;

a second arm hingedly coupled to the speed reducer and configured to move the door rail slider, wherein a rotational force of the pulley is to be transmitted to the second arm to open or close the door while unfolding and deploying the second arm in a direction toward the outside of the vehicle body or folding the second arm in a direction toward the inside of the vehicle body; and a wire wound around the pulley, wherein the wire is configured to be returned to the pulley via a connecting roller provided on a body of the vehicle body rail slider.

2. The apparatus of claim 1, further comprising a first arm connected to the vehicle body rail slider and a bracket hinge provided at one side of the first arm, the bracket hinge configured to be hingedly coupled to a bracket attached to the door panel.

3. The apparatus of claim 2, further comprising a slider hinge provided at another side of the first arm and hingedly coupled to a body of the vehicle body rail slider, wherein the first arm can be moved forward or rearward along with a movement of the door by an operation of opening or closing the door to open or close the door together with the second arm.

4. The apparatus of claim 2, wherein the second arm is connected to the door rail slider, one hinge of the second arm is hingedly coupled to the door rail slider, and another hinge of the second arm is hingedly coupled to a shaft of the speed reducer.

5. The apparatus of claim 2, wherein when the vehicle body rail slider is moved in conjunction with the operation of the door, the pulley is configured to be rotated by movement of the wire.

6. The apparatus of claim 2, further comprising:

a center rail installed at a central portion of the door panel of the door coupled to the vehicle body; and a center rail slider installed to be movable in the front-rear direction along the center rail.

7. The apparatus of claim 6, wherein the center rail slider is configured to be connected to a center rail roller attached to the vehicle body.

8. The apparatus of claim 1, wherein the second arm is connected to the door rail slider, one hinge of the second arm is hingedly coupled to the door rail slider, and another hinge of the second arm is hingedly coupled to a shaft of the speed reducer.

9. The apparatus of claim 8, further comprising:

a center rail installed at a central portion of the door panel of the door coupled to the vehicle body; and a center rail slider installed to be movable in the front-rear direction along the center rail.

10. The apparatus of claim 1, wherein when the vehicle body rail slider is moved in conjunction with the operation of the door, the pulley is configured to be rotated by movement of the wire.

11. The apparatus of claim 1, further comprising:

a center rail installed at a central portion of the door panel of the door coupled to the vehicle body; and a center rail slider installed to be movable in the front-rear direction along the center rail.

12. The apparatus of claim 11, wherein the center rail slider is configured to be connected to a center rail roller attached to the vehicle body.

13. A method of operating a door of a vehicle that comprises a vehicle body, a door rail installed on a door panel of the door, a vehicle body rail coupled to the vehicle body so as to be opposite to the door rail, a vehicle body rail slider coupled to one surface of the vehicle body rail, a door rail slider coupled to the door rail, a pulley rotatable in conjunction with a movement of the vehicle body rail slider, a speed reducer directly connected to the pulley, and a second arm hingedly coupled to the speed reducer, the method comprising:

opening or closing the door to rotate the pulley thereby sliding the vehicle body rail slider in a front-rear direction on the vehicle body rail and sliding the door rail slider and the door rail in the front-rear direction on the vehicle body rail, wherein a rotational force of the pulley is transmitted to the second arm to open or close the door while unfolding and deploying the second arm in a direction towards an outside of the vehicle body or folding the second arm in a direction toward an inside of the vehicle body;

wherein a wire is wound around the pulley;

wherein the pulley is rotated by the movement of the wire when the vehicle body rail slider is moved by opening or closing the door; and wherein the wire is returned to the pulley via a connecting roller provided on a body of the vehicle body rail slider.

14. The method of claim 13, wherein:

the vehicle further comprises a first arm connected to the vehicle body rail slider, a bracket hinge provided at one side of the first arm and hingedly coupled to a bracket attached to the door panel, and a slider hinge provided at another side of the first arm and hingedly coupled to a body of the vehicle body rail slider; and opening or closing the door causes the first arm to be moved forward or rearward along with a movement of the door to open or close the door together with the second arm.

15. The method of claim 13, wherein the second arm is connected to the door rail slider, one hinge of the second arm is hingedly coupled to the door rail slider, and another hinge of the second arm is hingedly coupled to a shaft of the speed reducer.

16. The method of claim 13, wherein:

the vehicle further comprises a center rail installed at a central portion of the door panel of the door coupled to the vehicle body and a center rail slider installed to be movable in the front-rear direction along the center rail; and the center rail slider is connected to a center rail roller attached to the vehicle body.

17. A vehicle comprising:

a vehicle body;

a door coupled to the vehicle body, the door including a door panel;

a door rail installed on the door panel of the door;

a vehicle body rail coupled to the vehicle body so as to be opposite to the door rail;

a vehicle body rail slider coupled to one surface of the vehicle body rail so as to be slidable in a front-rear direction along the vehicle body rail;

a door rail slider coupled to the door rail so as to be slidable in the front-rear direction along the door rail;

a pulley rotatable in conjunction with a movement of the vehicle body rail slider, wherein the vehicle body rail slider and the door rail slider can slide in the front-rear direction on the vehicle body rail and the door rail, respectively by an operation of opening or closing the door to rotate the pulley;

a speed reducer directly connected to the pulley;

a second arm hingedly coupled to the speed reducer and configured to move the door rail slider, wherein a rotational force of the pulley is to be transmitted to the second arm to open or close the door while unfolding and deploying the second arm in a direction toward the outside of the vehicle body or folding the second arm in a direction toward the inside of the vehicle body;

a connecting roller provided on a body of the vehicle body rail slider; and a wire wound around the pulley and returnable to the pulley via the connecting roller, wherein the pulley is configured to be rotated by the movement of the wire when the vehicle body rail slider is moved in conjunction with the operation of the door.

18. The vehicle of claim 17, further comprising a first arm connected to the vehicle body rail slider, a bracket hinge provided at one side of the first arm and hingedly coupled to a bracket attached to the door panel, and a slider hinge provided at another side of the first arm and hingedly coupled to a body of the vehicle body rail slider, wherein the first arm is movable forward or rearward along with a movement of the door by an operation of opening or closing the door to open or close the door together with the second arm.

19. The vehicle of claim 17, wherein the second arm is connected to the door rail slider, one hinge of the second arm is hingedly coupled to the door rail slider, and another hinge of the second arm is hingedly coupled to a shaft of the speed reducer.

20. The vehicle of claim 17, further comprising:

a center rail installed at a central portion of the door panel of the door coupled to the vehicle body; and a center rail slider installed to be movable in the front-rear direction along the center rail, wherein the center rail slider is connected to a center rail roller attached to the vehicle body.

* * * * *